US007380928B2

(12) United States Patent
Leighton

(10) Patent No.: US 7,380,928 B2
(45) Date of Patent: Jun. 3, 2008

(54) STATIC ELIMINATING SOLID INK CONTAINER

(75) Inventor: Roger Leighton, Rochester, NY (US)

(73) Assignee: Xerox Corporation, Norwalk, CT (US)

( * ) Notice: Subject to any disclaimer, the term of this patent is extended or adjusted under 35 U.S.C. 154(b) by 400 days.

(21) Appl. No.: 11/094,857

(22) Filed: Mar. 31, 2005

(65) Prior Publication Data

US 2006/0227192 A1 Oct. 12, 2006

(51) Int. Cl.
*B41J 2/175* (2006.01)

(52) U.S. Cl. ..... 347/99; 347/84; 347/85; 347/88

(58) Field of Classification Search ..... 347/88, 347/99, 84, 85, 86
See application file for complete search history.

(56) References Cited

U.S. PATENT DOCUMENTS

| | | | | |
|---|---|---|---|---|
| 4,636,803 | A | 1/1987 | Mikalsen | |
| 4,739,339 | A | 4/1988 | DeYoung et al. | |
| 5,038,157 | A | 8/1991 | Howard | |
| 5,372,852 | A | 12/1994 | Titterington et al. | |
| 5,495,323 | A | 2/1996 | Meetze, Jr. | |
| 5,742,313 | A * | 4/1998 | Hine | 347/92 |
| 6,053,608 | A | 4/2000 | Ishii et al. | |
| 6,096,125 | A | 8/2000 | Breton et al. | |
| 6,319,310 | B1 | 11/2001 | Wong et al. | |
| D453,787 | S | 2/2002 | Mattern | |
| 6,665,505 | B2 | 12/2003 | Meetze, Jr. et al. | |
| 2003/0118375 | A1 | 6/2003 | Litwiller | |

FOREIGN PATENT DOCUMENTS

| | | |
|---|---|---|
| EP | 0 336 043 A2 | 10/1989 |
| JP | 59 199279 | 11/1984 |

* cited by examiner

*Primary Examiner*—Manish S. Shah
*Assistant Examiner*—Laura E Martin
(74) *Attorney, Agent, or Firm*—Tallam I. Nguti

(57) ABSTRACT

A static eliminating container is provided for storing and supplying a quantity of solid phase-change ink pastilles. The static eliminating container includes (a) a closed end; (b) an open end opposite the closed end; (c) at least one cylindrical member connecting the closed end to the open end and having an interior surface defining a chamber for containing and frictionally moving the quantity of solid phase-change ink pastilles; and (d) static eliminating apparatus including (i) a conductive interior portion for contacting the quantity of solid phase change ink pastilles being contained and moved therein; (ii) a groundable conductive exterior portion; and (iii) a conductive connector for connecting the conductive interior portion to the groundable conductive exterior portion, thereby enabling dissipation of static build up from frictionally moving the quantity of solid phase-change ink pastilles within the interior chamber.

12 Claims, 4 Drawing Sheets

STATIC ELIMINATING SOLID INK CONTAINER

RELATED APPLICATION

This application is related to U.S. application Ser. No. 11/095,174 entitled "Solid Ink Pastilles" filed on even date herewith, and having at least one common inventor.

BACKGROUND

This invention relates generally to solid ink forms, and more particularly to solid ink pastilles for use in high-speed solid ink jet printers.

In general, phase change ink image producing machines or printers employ phase change inks that are in the solid phase at ambient temperature, but exist in the molten or melted liquid phase (and can be ejected as drops or jets) at the elevated operating temperature of the machine or printer. At such an elevated operating temperature, droplets or jets of the molten or liquid phase change ink are ejected from a printhead device of the printer onto a printing media. Such ejection can be directly onto a final image receiving substrate, or indirectly onto an imaging member before transfer from it to the final image receiving media. In any case, when the ink droplets contact the surface of the printing media, they quickly solidify to create an image in the form of a predetermined pattern of solidified ink drops.

An example of such a phase change ink image producing machine or printer, and the process for producing images therewith onto image receiving sheets is disclosed in U.S. Pat. No. 5,372,852 issued Dec. 13, 1994 to Titterington et al. As disclosed therein, the phase change ink printing process includes raising the temperature of a solid form of the phase change ink so as to melt it and form a molten liquid phase change ink. It also includes applying droplets of the phase change ink in a liquid form onto an imaging surface in a pattern using a device such as an ink jet printhead. The process then includes solidifying the phase change ink droplets on the imaging surface, transferring them the image receiving substrate, and fixing the phase change ink to the substrate.

As is well known in the art, phase change inks used in such machines are waxy, melt at less than about 120. degree. C, and therefore are very different from dry powder toners that are used in xerographic machines. Examples of such phase change inks are disclosed in the following references. U.S. Pat. No. 6,319,310 issued Nov. 20, 2001 and entitled "Phase Change Ink Compositions" discloses a phase change ink comprising (a) a carbamate or thiourea, said carbamate or thiourea having a melting point of no higher than about 120. degree. C. and an acoustic loss value of no more than about 100 decibels per millimeter, (b) a colorant, (c) a branched hydrocarbon with a number average molecular weight of no more than about 10,000 and a melting point or softening point of no more than about 120. degree. C., (d) an optional plasticizer, (e) an optional alcohol having a melting point of less than about 90. degree. C. and an acoustic loss value of no more than about 100 decibels per millimeter, (f) an optional lightfastness-imparting agent, and (g) an optional antioxidant.

U.S. Pat. No. 6,096,125 issued Aug. 1, 2000 and entitled "Ink Compositions" discloses an ink composition comprised of (1) a mixture comprised of a salt and an oxyalkylene compound wherein the conductive mixture possesses a melting point of from about 60. degree. C. to about 120. degree. C.; (2) an ink vehicle compound with a melting point of from about 80. degree. C. to about 100. degree. C.; (3) a viscosity modifying amide compound; (4) a lightfastness component; (5) a lightfastness antioxidant; and (6) a colorant.

In xerography which utilizes dry powder toners instead of solid inks like those above, it is known to use ordinary containers as disclosed for example in U.S. Pat. No. 5,495,323 issued Feb. 27, 1996; and U.S. Pat. No. 6,665,505 issued Dec. 16, 2003 to contain and feed a quantity of easy flowing dry toner particles to a machine development station.

In solid ink printing however, the conventional solid form of the phase change is a "stick", "block", "bar" or "pellet" as disclosed for example in U.S. Pat. No. 4,636,803 (rectangular block 24, cylindrical block 224); U.S. Pat. No. 4,739,339 (cylindrical block 22); U.S. Pat. No. 5,038,157 (hexagonal bar 12); U.S. Pat. No. 6,053,608 (tapered lock with a stepped configuration). Further examples of such solid forms are also disclosed in design patents such as U.S. Design Pat. No. D453,787 issued Feb. 19, 2002. In use, each such block form "stick", "block", "bar" or "pellet" is fed into a heated melting device that melts or phase changes the "stick", "block", "bar" or "pellet" directly into a print head reservoir for printing as described above.

Additionally it has been further merely suggested in U.S. Pat. No. 4,636,803 that the solid ink therein can be provided and handled in granular form. As described therein, a substantially cylindrical housing receives an auger that is rotated by a motor. Interstices between the cylindrical housing and a surface of the auger are filled with the solid-state ink in granular form. As the auger rotates, the ink in granular form approaches a discharge location and falls through the discharge opening into a trough. It has been found however that ordinarily attempting to feed solid ink in particulate or granular form frictionally by rotational contact within a container results in undesirable generation and imparting of electrostatic charge to the solid ink particles, which in turn causes undesirable clogging and bridging of the solid ink particles within the container.

SUMMARY

In accordance with the present disclosure, there has been provided a static eliminating container for storing and supplying a quantity of solid phase-change ink pastilles. the static eliminating container includes (a) a closed end; (b) an open end opposite the closed end; (c) at least one cylindrical member connecting the closed end to the open end and having an interior surface defining a chamber for containing and frictionally moving the quantity of solid phase-change ink pastilles; and (d) static eliminating apparatus including (i) a conductive interior portion for contacting the quantity of solid phase change ink pastilles being contained and moved therein; (ii) a groundable conductive exterior portion; and (iii) a conductive connector for connecting the conductive interior portion to the groundable conductive exterior portion, thereby enabling dissipation of static build up from frictionally moving the quantity of solid phase-change ink pastilles within the interior chamber

DETAILED DESCRIPTION

Figure 1:
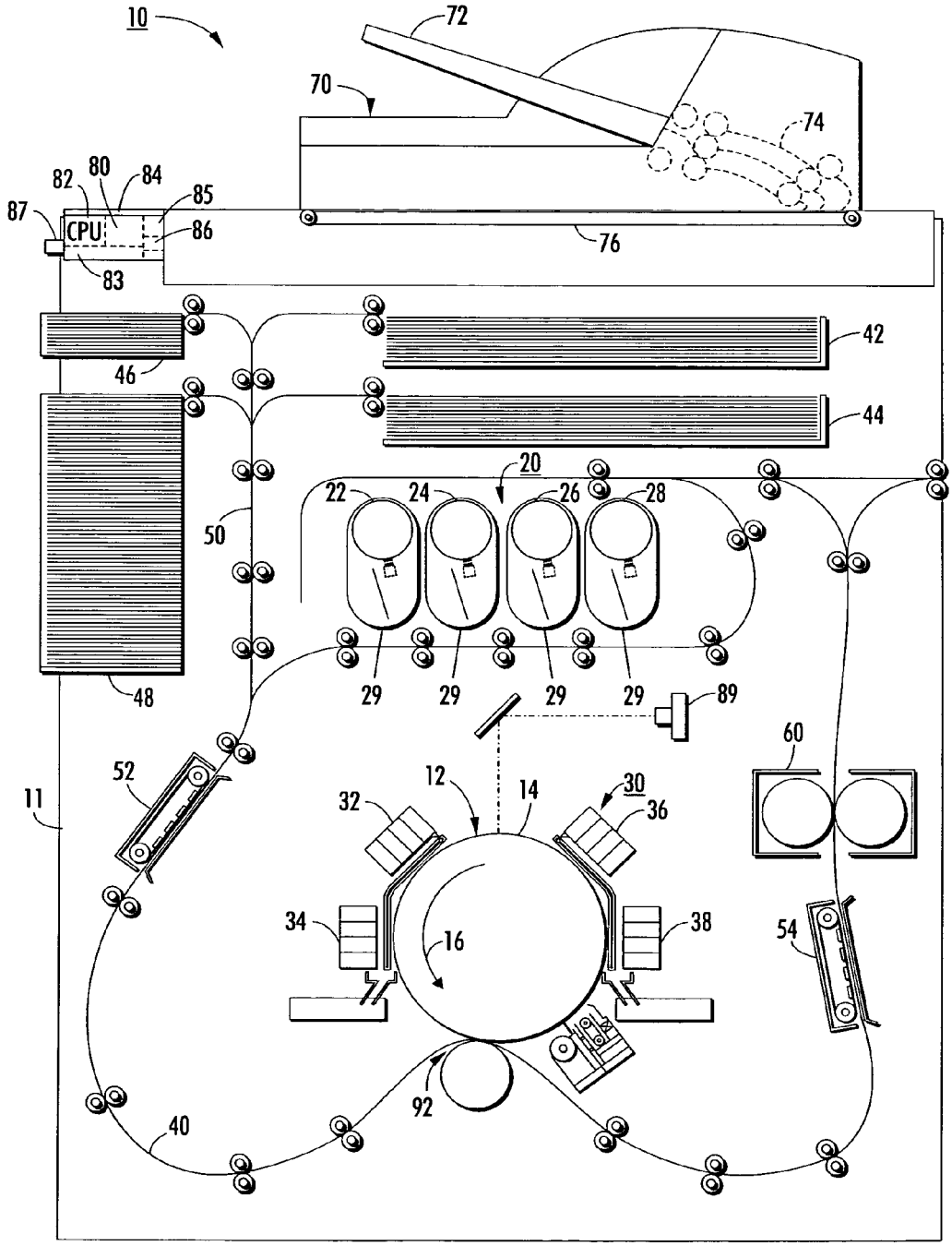
FIG. 1 is a vertical schematic of a high speed exemplary phase change ink image producing machine including the static eliminating solid ink container of the present disclosure.

Referring now to FIG. 1, there is illustrated an image producing machine, such as the high-speed phase change ink image producing machine or printer 10 of the present disclosure. As illustrated, the machine 10 includes a frame 11 to which are mounted directly or indirectly all its operating subsystems and components, as will be described below. To start, the high-speed phase change ink image producing machine or printer 10 includes an imaging member 12 that is shown in the form of a drum, but can equally be in the form of a supported endless belt. The imaging member 12 has an imaging surface 14 that is movable in the direction 16, and on which phase change ink images are formed.

The high-speed phase change ink image producing machine or printer 10 also includes a phase change ink delivery subsystem 20 that has at least one source 22 of one color phase change ink in solid form, specifically in the granular or pastille form in accordance with the present disclosure. Since the phase change ink image producing machine or printer 10 is a multicolor image producing machine, the ink delivery system 20 includes four (4) sources 22, 24, 26, 28, (to be described in detail below) representing four (4) different colors CYMK (cyan, yellow, magenta, black) of phase change inks. The phase change ink delivery system also includes a melting and control apparatus (not shown) for melting or phase changing the solid form pastilles of the phase change ink into a liquid form. The phase change ink delivery system is suitable for then supplying the liquid form to a printhead system 30 including at least one printhead assembly 32. Since the phase change ink image producing machine or printer 10 is a high-speed, or high throughput, multicolor image producing machine, the printhead system 30 includes multicolor ink printhead assemblies and a plural number (e.g. four (4)) of separate printhead assemblies 32, 34, 36 and 38 as shown.

As further shown, the phase change ink image producing machine or printer 10 includes a substrate supply and handling system 40. The substrate supply and handling system 40 for example may include substrate supply sources 42, 44, 46, 48, of which supply source 48 for example is a high capacity paper supply or feeder for storing and supplying image receiving substrates in the form of cut sheets for example. The substrate supply and handling system 40 in any case includes a substrate handling and treatment system 50 that has a substrate pre-heater 52, substrate and image heater 54, and optionally a fusing device 60. The phase change ink image producing machine or printer 10 as shown may also include an original document feeder 70 that has a document holding tray 72, document sheet feeding and retrieval devices 74, and a document exposure and scanning system 76.

Operation and control of the various subsystems, components and functions of the machine or printer 10 are performed with the aid of a controller or electronic subsystem (ESS) 80. The ESS or controller 80 for example is a self-contained, dedicated mini-computer having a central processor unit (CPU) 82, electronic storage 83, and a display or user interface (UI) 84. The ESS or controller 80 for example includes sensor input and control means 85 as well as a pixel placement and control means 86. In addition the CPU 82 reads, captures, prepares and manages the image data flow between image input sources such as the scanning system 76, or an online or a work station connection 87, and the printhead assemblies 32, 34, 36, 38. As such, the ESS or controller 80 is the main multi-tasking processor for operating and controlling all of the other machine subsystems and functions.

In operation, image data for an image to be produced is sent to the controller 80 from either the scanning system 76 or via the online or work station connection 87 for processing and output to the printhead assemblies 32, 34, 36, 38. Additionally, the controller determines and/or accepts related subsystem and component controls, for example from operator inputs via the user interface 86, and accordingly executes such controls. As a result, appropriate color solid forms of phase change ink are melted and delivered to the printhead assemblies. Additionally, pixel placement control is exercised relative to the imaging surface 14 thus forming desired images per such image data, and receiving substrates are supplied by anyone of the sources 42, 44, 46, 48 and handled by means 50 in timed registration with image formation on the surface 14. Finally, the image is transferred within the transfer nip 88, from the surface 14 onto the receiving substrate for subsequent fusing at fusing device 60.

Referring now to FIGS. 1-4, details of the ink delivery system 20 that includes four (4) sources 22, 24, 26, 28 of solid ink pastilles are illustrated in accordance with the present disclosure. As pointed out above the delivery sources 22, 24, 26 and 28 represent four (4) different colors CYMK (cyan, yellow, magenta, black) of phase change inks. Except for the color differences, the sources 22, 24, 26 and 28 are identical so detailed description of one will suffice for the rest.

Figure 2:
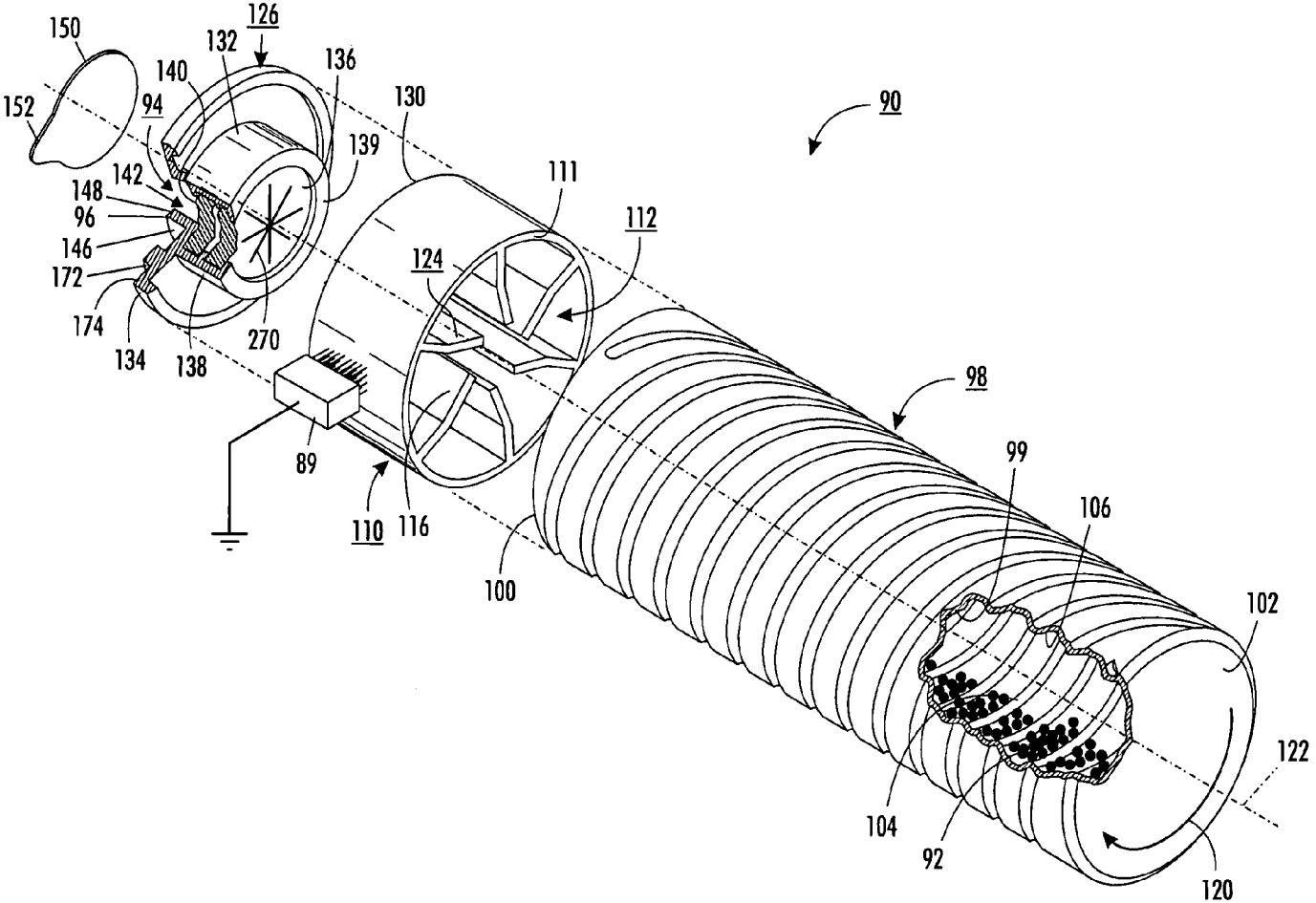
FIG. 2 is an exploded perspective view of a first embodiment of the static eliminating solid ink container according to the present disclosure.
Figure 3:
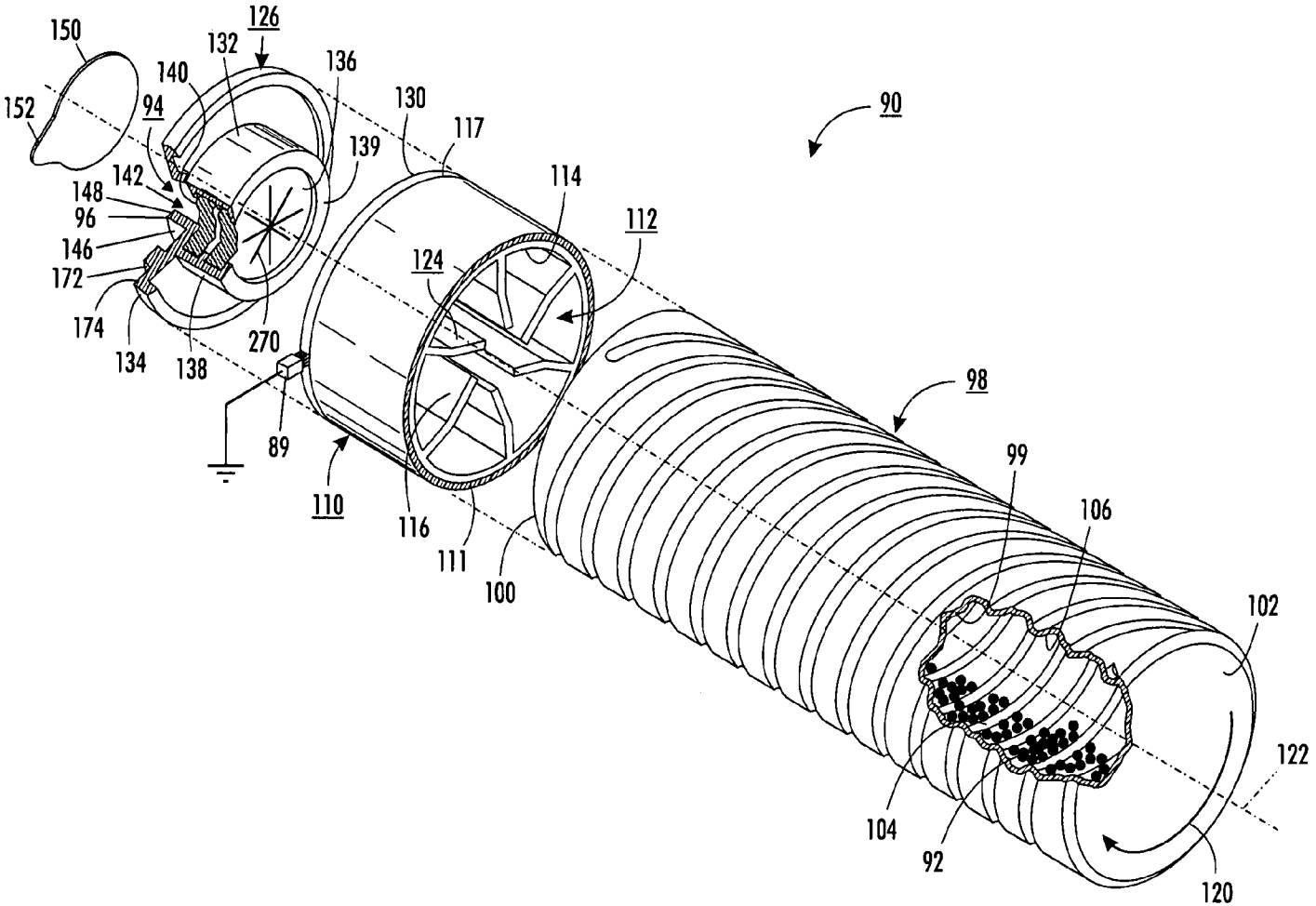
FIG. 3 is an exploded perspective view of a second embodiment of the static eliminating solid ink container according to the present disclosure.
Figure 4:
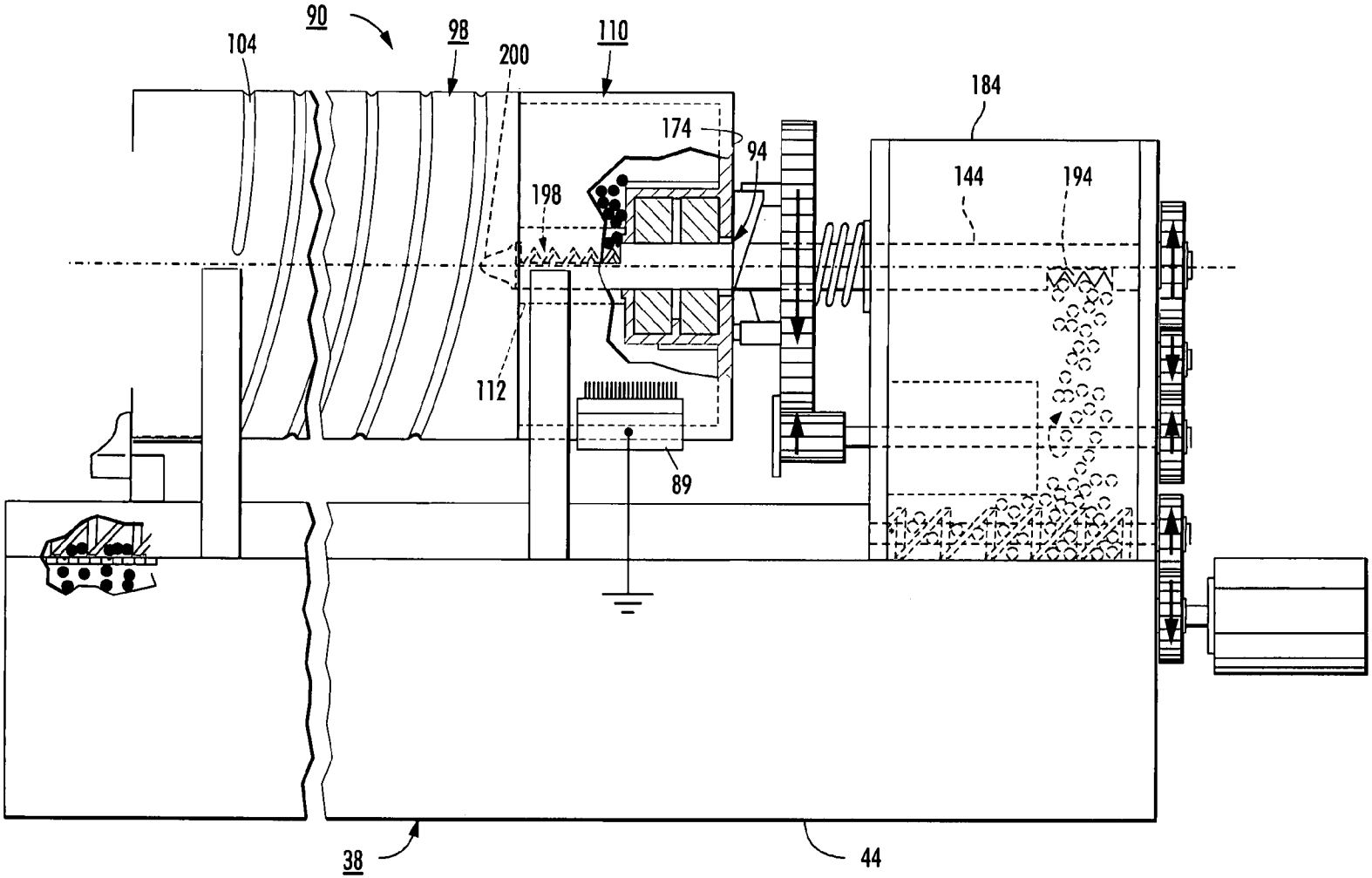
FIG. 4 is a plan view showing one of the solid ink supply sources of the machine of FIG. 1 including a static eliminating solid ink container of the present disclosure.

As illustrated in FIGS. 2-4, each source includes a static eliminating solid ink container 90 that is used to contain and store for supplying, a quantity of waxy solid ink pastilles 92. The static eliminating solid ink container 90 has a generally cylindrical shape and an opening 94 located on a first end 96 thereof. Preferably, it includes a first generally cylindrically shaped portion 98 having a shell or wall 99, an open end 100 proximate the opening 94, and a closed end 102 opposite the open end 100. To urge the solid ink pastilles 92 out of the first generally cylindrical shaped portion 98, the wall or shell 99 includes a spiral rib 104 located on an interior periphery 106 thereof. The spiral rib 104 may have either a right hand or a left hand orientation depending on the corresponding rotation of the static eliminating solid ink container 90 in the machine 10.

The static eliminating solid ink container 90 also includes a second cylindrical or ring shaped portion 110 that extends from the open end 100 of the first cylindrically shaped portion 98. The second cylindrical or ring shaped portion 110 includes a wall 111 and at least an inner periphery 114 and radial protrusions 112 that extend inwardly thereof towards the axis or centerline 122. The radial protrusions 112 each have a carrying face 116 that curves in the direction of rotation 120 of the container 90. The radial protrusions 112 thereby form pockets 124 along the carrying face 116 that become filled with a quantity of solid ink pastilles 92 when such pastilles are being moved from the open end 100 of the first cylindrical shape portion 98, and that carry such quantity of the pastilles 92 along the inner periphery of 114 for feeding out of the container 90.

As pointed out above, ordinarily attempting to rotate the container 90 to move and feed the pastilles 92 out of the container has been found to result in undesirable generation and imparting of electrostatic charge to pastilles 92 causing undesirable clogging and bridging within the container 90. Accordingly as shown in FIGS. 1-4, in order to resolve such problems, the container 90 has been provided with static eliminating features in accordance with the present disclosure (to be described in detail below).

In a first embodiment of the static eliminating solid ink container 90 as shown in FIG. 2, the walls or shells 99, 111 of both the first cylindrical member 98 and of second cylindrical member 110 respectively are made conductive, being for example molded out of a resin that includes a static elimination filler therein for bringing the surface resistivity thereof to between $10^{-6}$ to $10^{-9}$ ohms per square. As such, the inner peripheries 106 and 114, as well as the radial protrusions 112, which each contact the quantity of solid ink pastilles 92 being moved within the container 90, will also be conductive. For this embodiment as shown in FIG. 4, a conductive grounding brush 89, made for example of stainless steel fibers is connected to ground or mounted to the frame of the machine 10. As mounted and connected, the grounding brush 89 contacts a portion of the conductive exterior surface of either the first or second cylindrical member 98, 110 for eliminating or draining to ground charge build up from the pastilles 92 being moved inside the container 90.

In a second embodiment as shown in FIG. 3, the second cylindrical or ring shaped portion 110 includes a conductive insert 113 having an inner periphery 114 and an equally conductive washer-like portion extending to an external rim 117. As shown, the inner periphery 114 has conductive radial protrusions 112 that extend inwardly thereof towards the axis or centerline 122. The radial protrusions 112 each have a carrying face 116 that curves in the direction of rotation 120 of the container 90. The radial protrusions 112 thereby form pockets 124 along the carrying face 116 that become filled with a quantity of solid ink pastilles 92 when such pastilles are being moved from the open end 100 of the first cylindrical shape portion 98, and that carry such quantity of the pastilles 92 along the inner periphery of 114 for feeding out of the container 90.

As further illustrated, the static eliminating solid ink container 90 includes a plate shaped end portion 126 that extends from a second face 130 of the second cylindrical or ring shaped portion 110. The plate shaped portion 126 includes the first end 96 of the container 90 as well as the opening 94 of the container 90. The plate shaped portion 126 also includes an interior hub 132 that extends inwardly from a disc area 134 of the end portion 126. A puncturable seal 136 is preferably located against an inside face 138 of a lip 139 of the interior hub 132, and is contained within the interior hub 132. The seal 136 serves to contain the solid ink pastilles 92 during installation and removal of the static eliminating solid ink container 90 from the machine 10.

To provide sealing in addition to the puncturable seal 136 when the container 90 is installed into the machine 10, a secondary seal 140 is provided and is located in the interior hub 132 spaced outwardly from, and parallel to, the puncturable seal 136. It should be appreciated that the interior hub 132 may be either a separate component or an integral part of container 90. The secondary seal 140 contains a central opening 142 that slidably fits over an auger tube 144 and seals thereto upon installation into the ink supply source apparatus 29.

Referring now to FIGS. 1 and 4, the ink supply source apparatus 29 includes a plate shaped end portion 126 that has an exterior hub 146 extending outwardly from a disc area 134. The plate shaped end portion 126 further includes pins 172 extending outwardly from outer face 174 of the disc area 134 that are used to interconnect with the ink supply source apparatus 29. The exterior hub 146 includes an exterior face 148 to which a cover seal 150 is secured during transportation and storage of the static eliminating solid ink container 90. The cover seal 150 is secured to face 148 by any suitable means such as by gluing. The seal 150 is made from a gas permeable material. The seal 150 will permit air pressure to be relieved during high altitude shipping or temperature cycling, thus preventing popping of the seal. Tyvek™ material is particularly well suited for this application. The cover seal 150 is used solely during shipment and is removed prior to installation of the container 90 into the machine 10. Preferably, the cover seal 150 includes a tab 152 extending from the seal 150 which may be used in removing the cover seal 150.

Referring now to FIG. 4, the static eliminating solid ink container 90 is shown installed in the ink supply source apparatus 29 with centerline 122 thereof in a horizontal orientation. Upon installation, the static eliminating solid ink container 90 is supported by bottle supports 180. While a plurality of bottle supports 180 is shown in FIG. 4, it can well be appreciated that one wider bottle support may serve equally as well. Exterior surface 182 of the static eliminating solid ink container 90 contacts the bottle supports 180 and is supported thereby.

The ink supply source apparatus 29 includes the housing 44 from which the bottle supports 180 extend. A housing portion 184 extends upwardly from one end 186 of the housing 44. A feed mechanism 190 extends through the housing portion 184 and outwardly therefrom in the direction of centerline 192. The feed mechanism 190 extends through opening 94 of the static eliminating solid ink container 90, centerline 192 being co-linear with centerline 122. Preferably, the feed mechanism 190 is in the form of an auger 194 that is located within tube 144. The tube 144 preferably has an inlet opening 198 in the upper portion of the tube 144 near a first end 200 of the tube 144. The tube 144 also has an outlet opening 202 in the bottom portion of the tube 144 near second end 204 of the tube 144.

The ink supply source apparatus 29 further includes a container drive motor 210 which may be located anywhere within the ink supply source apparatus 29, but preferably, is secured to the housing portion 184. The container drive motor 210 serves to rotate the static eliminating solid ink container 90 as well as auger 194. It should be appreciated, however, that the invention may be practiced with a separate motor for the auger 194 and a separate motor for the static eliminating solid ink container 90. Any suitable gear train may be used to connect the motor 210 to the auger 194 and to the static eliminating solid ink container 90. For example, the motor 210 may have a pinion gear 212 extending inwardly therefrom. A sun gear 214 slidably rotates about tube 144 and meshes with pinion gear 212.

To urge the sun gear 214 against the container 90 and assure the mating of the pins 172 with the stops 216, preferably, the ink supply source apparatus 29 further includes a spring 224 slidably fitted about tube 144 between the housing portion 184 and second face 226 of the sun gear 214. To interconnect the static eliminating solid ink container 90 to the feed mechanism 190, stops 216 are located on the face 220 of the sun gear 214 and are aligned adjacent the pins 172 of the container 90 to cooperate therewith.

Thus in general, the static eliminating container includes (a) a closed end; (b) an open end opposite the closed end; (c) at least one cylindrical member connecting the closed end to the open end and having an interior surface defining a chamber for containing and frictionally moving the quantity of solid phase-change ink pastilles; and (d) static eliminating apparatus including (i) a conductive interior portion for contacting the quantity of solid phase change ink pastilles being contained and moved therein; (ii) a groundable conductive exterior portion; and (iii) a conductive connector for connecting the conductive interior portion to the groundable conductive exterior portion, thereby enabling dissipation of static build up from frictionally moving the quantity of solid phase-change ink pastilles within the interior chamber.

In the first embodiment FIG. 2, the conductive interior portion comprises all of the conductive interior surface 106, and the conductive connector comprises the conductive shell or wall 99 of the cylindrical member 98 for example. Similarly, the groundable conductive exterior portion comprises all of a conductive exterior surface of the conductive shell 99 including that of the wall 111 of the second cylindrical member 110 mounted adjacent the open end 100.

In the second embodiment of FIG. 3, the static eliminating apparatus includes (i) the conductive insert 113 mounted within the second cylindrical member 110, including the conductive inwardly extending radial protrusions 112 for contacting and moving the quantity of solid phase-change ink pastilles from the chamber; and (ii) the washer-like portion having the groundable conductive exterior rim 117 for connecting to ground, thereby enabling dissipation of static build up from frictionally moving the quantity of solid phase-change ink pastilles from the chamber.

As can be seen, there has been provided a static eliminating container for storing and supplying a quantity of solid phase-change ink pastilles. the static eliminating container includes (a) a closed end; (b) an open end opposite the closed end; (c) at least one cylindrical member connecting the closed end to the open end and having an interior surface defining a chamber for containing and frictionally moving the quantity of solid phase-change ink pastilles; and (d) static eliminating apparatus including (i) a conductive interior portion for contacting the quantity of solid phase change ink pastilles being contained and moved therein; (ii) a groundable conductive exterior portion; and (iii) a conductive connector for connecting the conductive interior portion to the groundable conductive exterior portion, thereby enabling dissipation of static build up from frictionally moving the quantity of solid phase-change ink pastilles within the interior chamber.

The claims, as originally presented and as they may be amended, encompass variations, alternatives, modifications, improvements, equivalents, and substantial equivalents of the embodiments and teachings disclosed herein, including those that are presently unforeseen or unappreciated, and that, for example, may arise from applicants/patentees and others.

What is claimed is:

1. A static eliminating container for storing and supplying a quantity of solid phase-change ink pastilles, the static eliminating container comprising:

(a) a closed end;

(b) an open end opposite said closed end;

(c) a first cylindrical member connected to said closed end and defining an interior surface; and (d) a static eliminating apparatus including (i) a wall defining a second cylindrical member connected to said first cylindrical member; (ii) a conductive insert mounted inside said wall of said second cylindrical member, said conductive insert having a washer-like portion; (iii) an external rim surface to said conductive insert; and (iv) a conductive grounding brush mounted into contact with said external rim surface and connected to ground.

2. The static eliminating container of claim 1, wherein said interior surface of said first cylindrical member is conductive.

3. The static eliminating container of claim 1, including a plate shaped end portion connected to said second cylindrical member and having a puncturable seal attached to said open end.

4. The static eliminating container of claim 1, including a spiral rib formed on an internal periphery of said first cylindrical member for urging the quantity of solid phase change ink pastilles being contained and moved within said static eliminating container toward the open end.

5. The static eliminating container of claim 1, including a cap for sealing said open end, said cap being in threaded engagement with said open end, and said cap including a waste container for storing waste material.

6. The static eliminating container of claim 1, wherein said insert includes radial protrusions having carrying surfaces for carrying a quantity of solid phase change ink pastilles being contained and moved within said static eliminating container.

7. The static eliminating container of claim 1 wherein said conductive grounding brush is made of stainless steel fibers.

8. The static eliminating container of claim 6, wherein said radial protrusions form pockets along said carrying surfaces.

9. A static eliminating container for storing and supplying a quantity of solid phase-change ink pastilles, the static eliminating container comprising:

(a) a closed end;

(b) an open end opposite said closed end;

(c) a first cylindrical member connecting said closed end to said open end and including a shell having an interior surface defining a chamber for containing and frictionally moving the quantity of solid phase-change ink pastilles within said chamber;

(d) a second cylindrical member mounted adjacent said open end; and (e) static eliminating apparatus including (i) a conductive insert mounted within said second cylindrical member and including conductive inwardly extending radial protrusions for contacting and moving the quantity of solid phase-change ink pastilles from said chamber; and (ii) a washer-like portion connected to said conductive insert and having a groundable conductive exterior rim for connecting to ground, thereby enabling dissipation of static build up from frictionally moving the quantity of solid phase-change ink pastilles from said chamber.

10. The static eliminating container of claim 9, including a puncturable seal attached to said open end for closing and sealing said chamber.

11. The static eliminating container of claim 9, including a spiral rib formed on an internal periphery of said container, for urging the particles in the chamber toward the open end of said chamber.

12. The static eliminating container of claim 9, including a cap for sealing the chamber of said container.

* * * * *